US010342308B2

(12) United States Patent
Nasrawi

(10) Patent No.: US 10,342,308 B2
(45) Date of Patent: Jul. 9, 2019

(54) SANITARY BATHROOM KIT

(71) Applicant: Alex Nasrawi, South Dartmouth, MA (US)

(72) Inventor: Alex Nasrawi, South Dartmouth, MA (US)

( * ) Notice: Subject to any disclaimer, the term of this patent is extended or adjusted under 35 U.S.C. 154(b) by 0 days.

(21) Appl. No.: 15/678,164

(22) Filed: Aug. 16, 2017

(65) Prior Publication Data

US 2018/0049525 A1 Feb. 22, 2018

Related U.S. Application Data

(60) Provisional application No. 62/375,494, filed on Aug. 16, 2016.

(51) Int. Cl.

| | |
|---|---|
| ***A47K 10/16*** | (2006.01) |
| ***A45C 11/00*** | (2006.01) |
| ***A47K 13/16*** | (2006.01) |

(52) U.S. Cl.

CPC ..... *A45C 11/008* (2013.01); *A47K 10/16* (2013.01); *A47K 13/165* (2013.01)

(58) Field of Classification Search

CPC ..... A45C 11/008; A45C 5/005; A47K 10/16; A47K 13/165

USPC ..... 206/223

See application file for complete search history.

(56) References Cited

U.S. PATENT DOCUMENTS

| | | | | |
|---|---|---|---|---|
| 5,024,536 | A * | 6/1991 | Hill | B65D 31/12 383/38 |
| 7,377,395 | B1 * | 5/2008 | Mak | A45C 11/008 206/473 |
| 8,596,458 | B1 * | 12/2013 | Alcorn | A45C 11/008 206/229 |
| 2004/0022458 | A1 * | 2/2004 | Mobs | B65D 75/40 383/37 |
| 2007/0209099 | A1 * | 9/2007 | Issachar | A47K 13/18 4/245.1 |
| 2012/0222203 | A1 * | 9/2012 | Hiltz | A47K 13/16 4/245.3 |
| 2013/0206640 | A1 * | 8/2013 | Mann, Jr. | A45C 11/008 206/581 |

* cited by examiner

*Primary Examiner* — King M Chu

(74) *Attorney, Agent, or Firm* — Bay State IP, LLC

(57) ABSTRACT

A new sanitary toilet kit system that provides a sanitary and flushable toilet seat cover and a sanitary flushable wipe that are sealed within the kit to ensure peak hygienic qualities. The toilet seat cover and wipe are sanitary, flushable, transportable, discreet, septic system safe, and environmentally safe. Further, the sanitary toilet kit system is disposable and provides a toilet seat cover with a traction side to prevent slippage when in use.

4 Claims, 8 Drawing Sheets

10

10

SANITARY BATHROOM KIT

CROSS REFERENCE TO RELATED APPLICATION

This application claims the benefit of and takes priority from U.S. Provisional Patent Application Ser. No. 62/375,494, filed on Aug. 16, 2016, the contents of which are herein incorporated by reference.

BACKGROUND OF THE INVENTION

Field of the Invention

The present invention generally relates to toilet kits for use in public restrooms and, more particularly, to toilet kits comprising a combination of elements providing sanitary protection for both a toilet seat, toilet bowl, and the user of the sanitary kit.

Background of the Invention

It is a common understanding that public restrooms often tend to be less clean and sanitary than one wishes. Because most public restrooms are used frequently by numerous people, it is sometimes difficult to determine the hygienic quality of the toilet seat or even when the last time the toilet was clean. Furthermore, the problem of wanting a clean toilet seat rings true especially for women who usually must utilize the public toilet seat more often than their male counterparts.

Since toilet seats are infamously unhygienic and breeding grounds for all types of bacteria, individuals are left sometimes covering the toilet seat with toilet paper or trying to relieve themselves by squatting over the toilet seat. These techniques may cause more of a mess in a public restroom.

Further, although some toilet seat covers exist, these items tend to be not flushable and require the user to dispose of them after use in a trash barrel. Moreover, other covers are made of plastic that tend to not be environmentally friendly and disposing of the covers causes an increase in pollution. In addition, many paper toilet covers that exist do not adhere or grip to the toilet seat and may fall off the seat before the user utilizes it.

Also, there is no guarantee that every public restroom contains a toilet cover or sanitary kit in order to sterilize a toilet seat. Thus, there is a need for a portable and compact sanitary toilet kit that provides a sanitary, flushable wipe, and a sanitary, flushable toilet cover that is non-slip when applied to a toilet seat and where both the wipe and toilet liner are septic tank safe and environmentally friendly when flushed.

SUMMARY OF THE INVENTION

The instant system, as illustrated herein, is clearly not anticipated, rendered obvious, or even present in any of the prior art mechanisms, either alone or in any combination thereof. Thus, the several embodiments of the instant system are illustrated herein.

In one aspect, the present system introduces a novel sanitary toilet kit, which may include a flushable toilet seat cover or liner, and at least one flushable sanitary wipe.

Another aspect of the present system provides a new toilet sanitary kit that includes a flushable toilet seat cover and a sanitary wipe that is environmentally friendly.

In another aspect, the system provides a new toilet sanitary kit that is portable and discreet for easy travel.

In another aspect, the system provides a new toilet sanitary kit, wherein both the toilet seat cover and the wipe is individually sealed within the kit providing extra protection and sanitation.

In yet another aspect, the system provides a new toilet sanitary kit that is user friendly and easy to utilize. In one embodiment, the system comprises a sanitary toilet kit with a toilet seat cover, wherein one side has adhering mechanisms to prevent slippage when the seat cover is in use.

Realizing one aspect of the system is a new sanitary toilet kit system that provides a sanitary and flushable toilet seat cover and a sanitary flushable wipe that are sealed within the kit to ensure peak hygienic qualities. The toilet seat cover and wipe are sanitary, flushable, transportable, discreet, septic system safe, and environmentally safe. Further, the sanitary toilet kit system is disposable and provides a toilet seat cover with a traction side to prevent slippage when in use.

These together with other objects of the system, along with the various features of novelty, which characterize the system, are pointed out with particularity in the claims annexed to and forming a part of this disclosure. For a better understanding of the system, its operating advantages and the specific objects attained by its uses, reference should be made to the accompanying drawings and descriptive matter in which there are illustrated preferred embodiments of the system.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION OF THE SEVERAL EMBODIMENTS

The detailed description set forth below in connection with the appended drawings is intended as a description of presently-preferred embodiments of the system and does not represent the only forms in which the present system may be constructed and/or utilized. The description sets forth the functions and the sequence of steps for constructing and operating the apparatus in connection with the illustrated embodiments. However, it is to be understood that the same or equivalent functions and sequences may be accomplished by different embodiments that are also intended to be encompassed within the spirit and scope of the invention.

Figure 1:
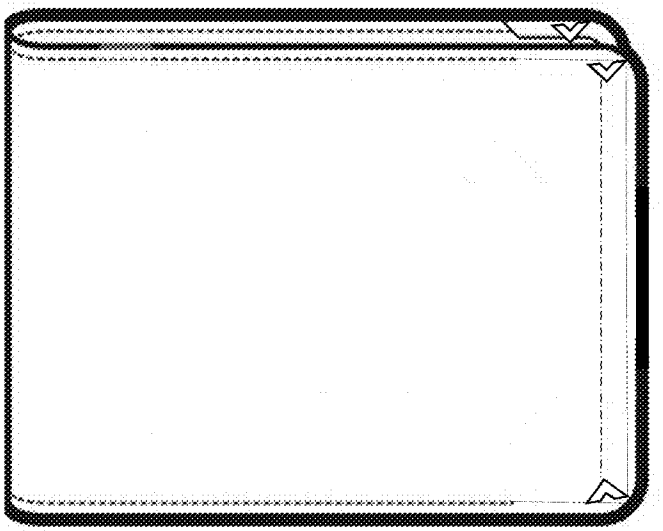
FIG. 1 illustrates a front perspective view of one embodiment of the sanitary toilet kit.

Referring now to the figures to better illustrate the present system, FIG. 1 illustrates a front view of a sanitary toilet kit 10 in an unopened position. When the sanitary toilet kit 10 is assembled in its packaging, the sanitary toilet kit 10 may be folded in half to allow the kit 10 easily fit into a user's pocket. Thus, the kit 10, when in the unopened position, is discrete and easy to travel with, allowing for any user to bring the sanitary toilet kit 10 into any restroom to ensure a clean bathroom experience.

Figure 2:
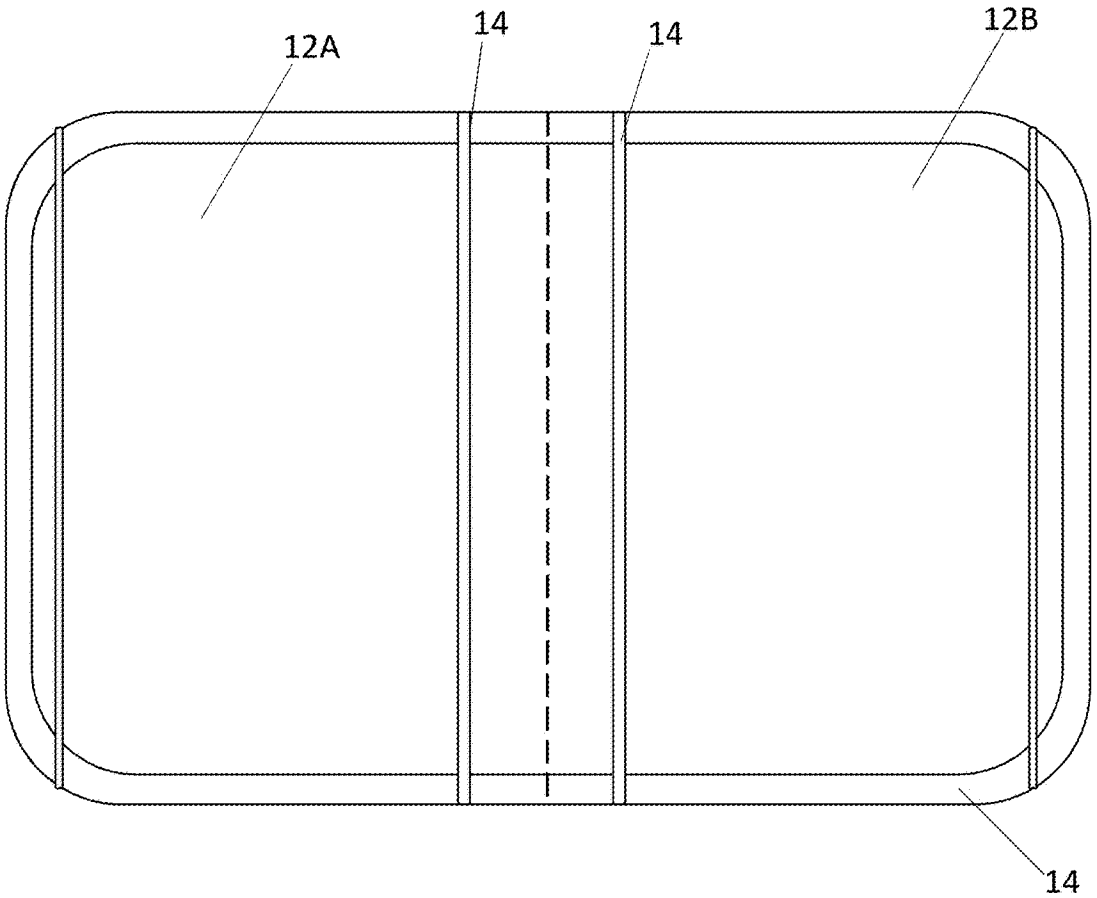
FIG. 2 illustrates the sanitary toilet kit when it is opened, displaying the sealed pockets on each side.

FIG. 2 illustrates one embodiment of the sanitary toilet kit 10, wherein the kit's 10 packaging is in an opened position to access a first sealed pocket 12A and a second sealed pocket 12B. Each sealed pocket 12A and 12B is sealed 14 all the way around the pocket to prevent any contamination of the contents within.

Figure 3:
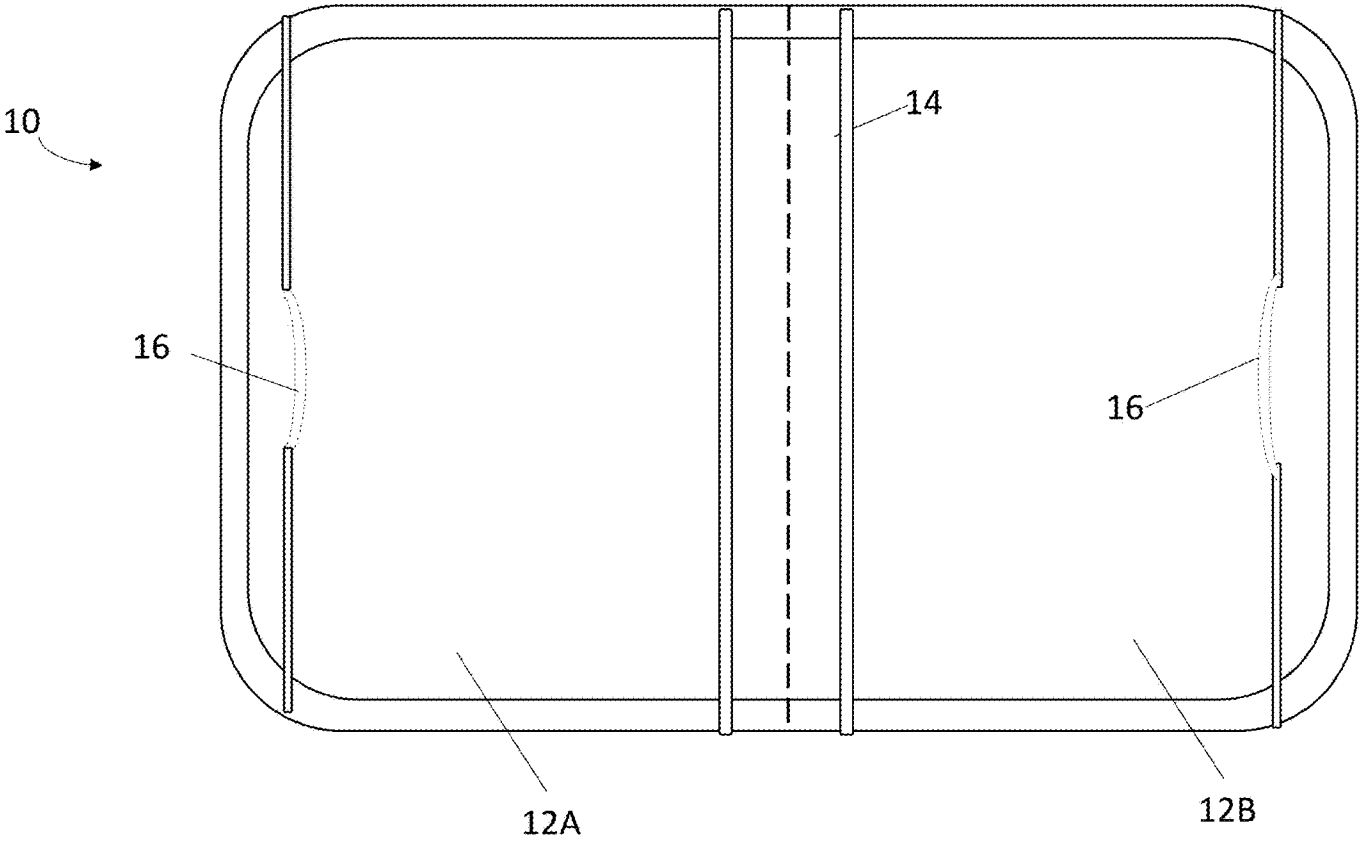
FIG. 3 illustrates the sanitary toilet kit when the sealed pockets are opened.

FIG. 3 illustrates one embodiment of the sanitary toilet kit 10, wherein the kit's packaging is in an open position and the sealed pockets are opened 16 in order to access the kit's contents. Herein, a user may break the seal 14 of either sealed pocket 12A or 12B. In order to access either a toilet seat cover or a sanitary wipe.

Figure 4:
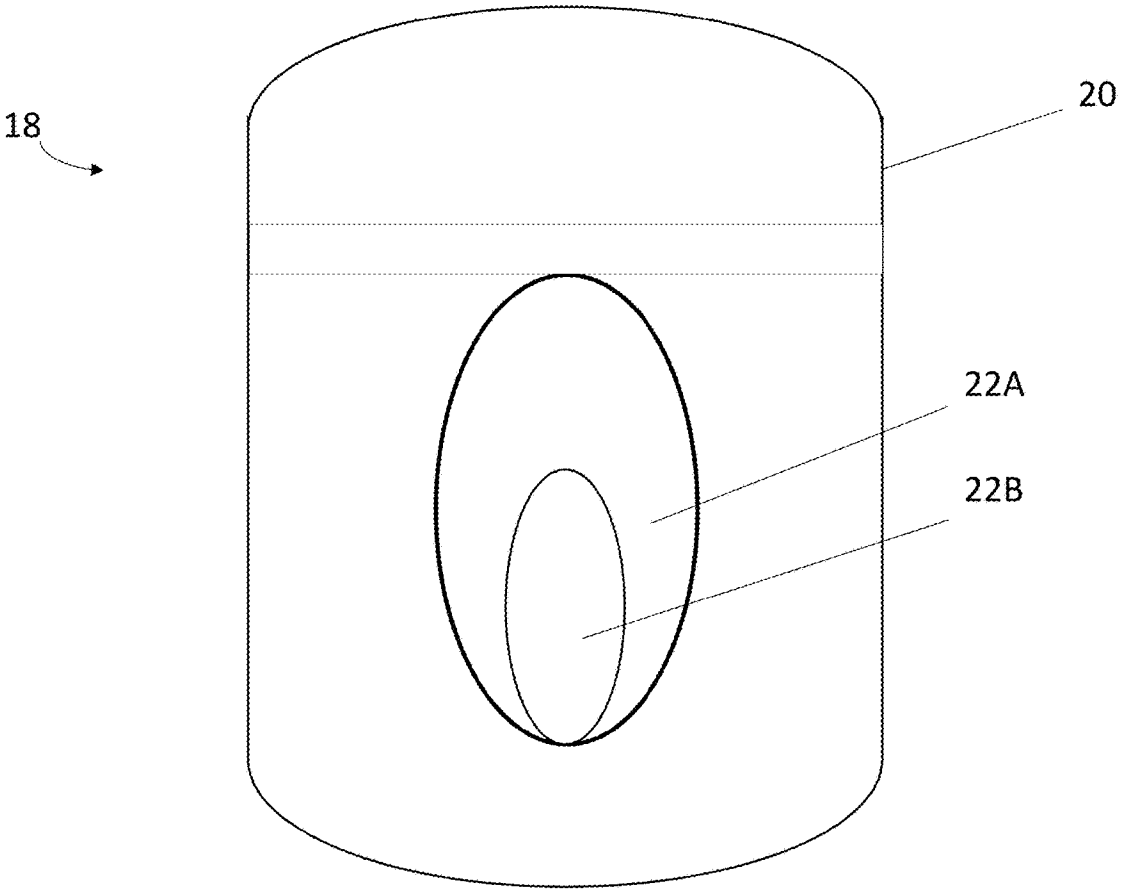
FIG. 4 illustrates a top view of one embodiment of the sanitary toilet kit's toilet seat cover or liner.

FIG. 4 illustrates a top view of one embodiment of the sanitary toilet kit's toilet seat cover or liner 18. Herein, a top side 20 of the toilet seat cover 18 comprises a smooth surface material. This smooth surface allows for no discomfort to the user when utilizing and using the toilet seat cover. The toilet seat cover 18 comprises an opening 22A that may be placed over the seat and aligned with the toilet bowl opening. Further, in another embodiment, there may be a toilet cut out flap 22B that may be placed within the toilet bowl. This feature helps prevent male body parts from touching any part of the bowl when sitting on the toilet seat. Once a user places the cover 18 over the toilet seat, the user has a barrier between their own body and the toilet seat, along with a completely hygienic and sanitary seat to use. The toilet seat liners may be customized to different sizes and shapes depending on the leading makes and models of public restroom toilets. The sanitary toilet seat cover 18 is designed to cover the whole seat of the toilet. The opening 22 is designed to align with the toilet bowl to avoid any mess after the user relieves himself.

Figure 5:
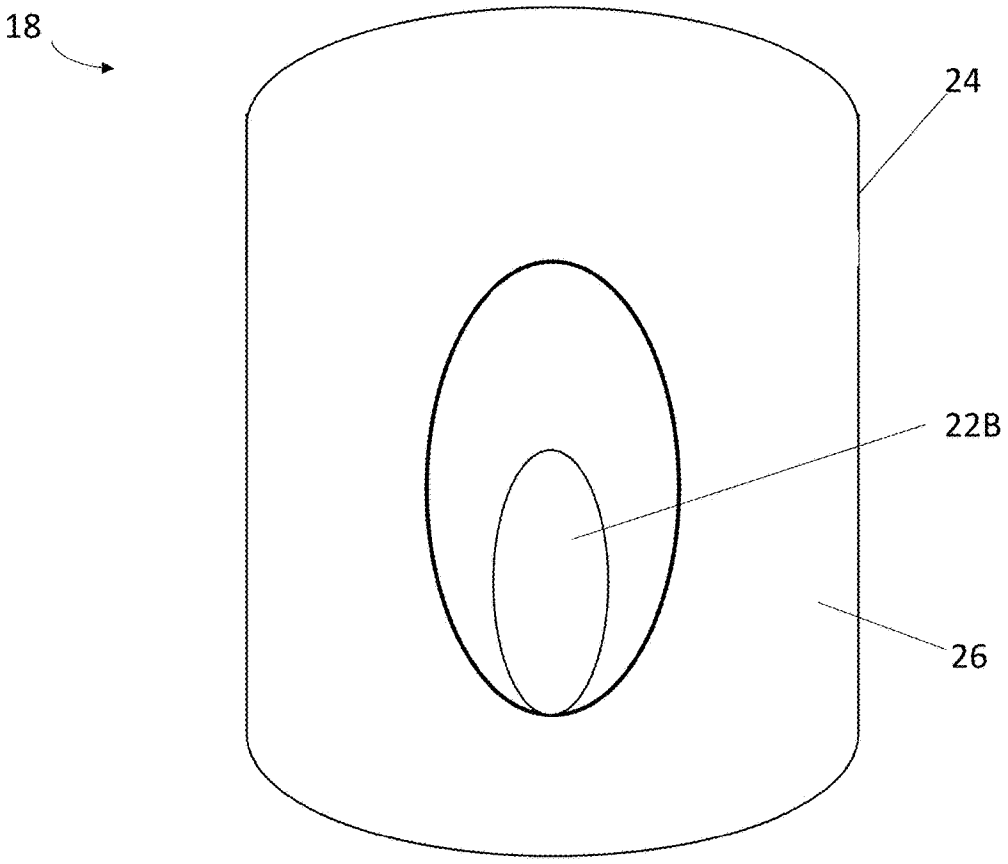
FIG. 5 illustrates a back view of one embodiment of the sanitary toilet kit's toilet seat cover or liner.

FIG. 5 illustrates a bottom view of one embodiment of the sanitary toilet kit's toilet seat cover or liner 18. Herein, a bottom side 24 of the toilet seat cover 18 comprises of a series of perforations or ribbed material 26 to ensure that when the toilet seat liner 18 is placed on the toilet seat, potential slippage of the toilet seat liner is avoided when the user attempts to sit on the liner. The bottom side 24 of the toilet seat liner 18 may also be constructed to contain an adhesive mechanism that allows for slippage of the toilet seat cover to be avoided. The toilet seat liner 18 may also be made from flushable material that is both septic system friendly and environmentally friendly. The toilet seat liner 18 may be water soluble to provide an eco-friendly cover that will not clog or back up a toilet system.

Figure 6:
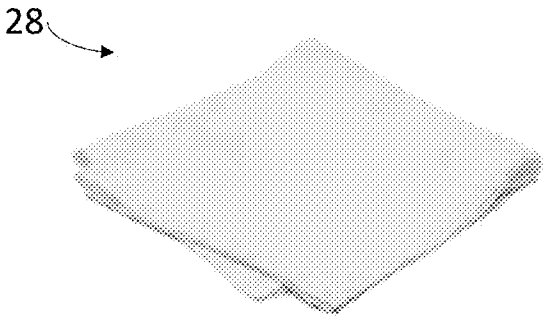
FIG. 6 illustrates a perspective view of one embodiment of the sanitary toilet kit's wipes.

FIG. 6 illustrates a perspective view of one embodiment of a sanitary wipe 28 that may be included as part of the sanitary toilet kit. The sanitary wipe 28 is made from flushable material that is both septic system friendly and environmentally friendly. The sanitary wipe may be water soluble to provide an eco-friendly wipe that will not clog or back up a toilet system. The kit 10 may include at least one sanitary wipe 28 per kit 10.

Figure 7:
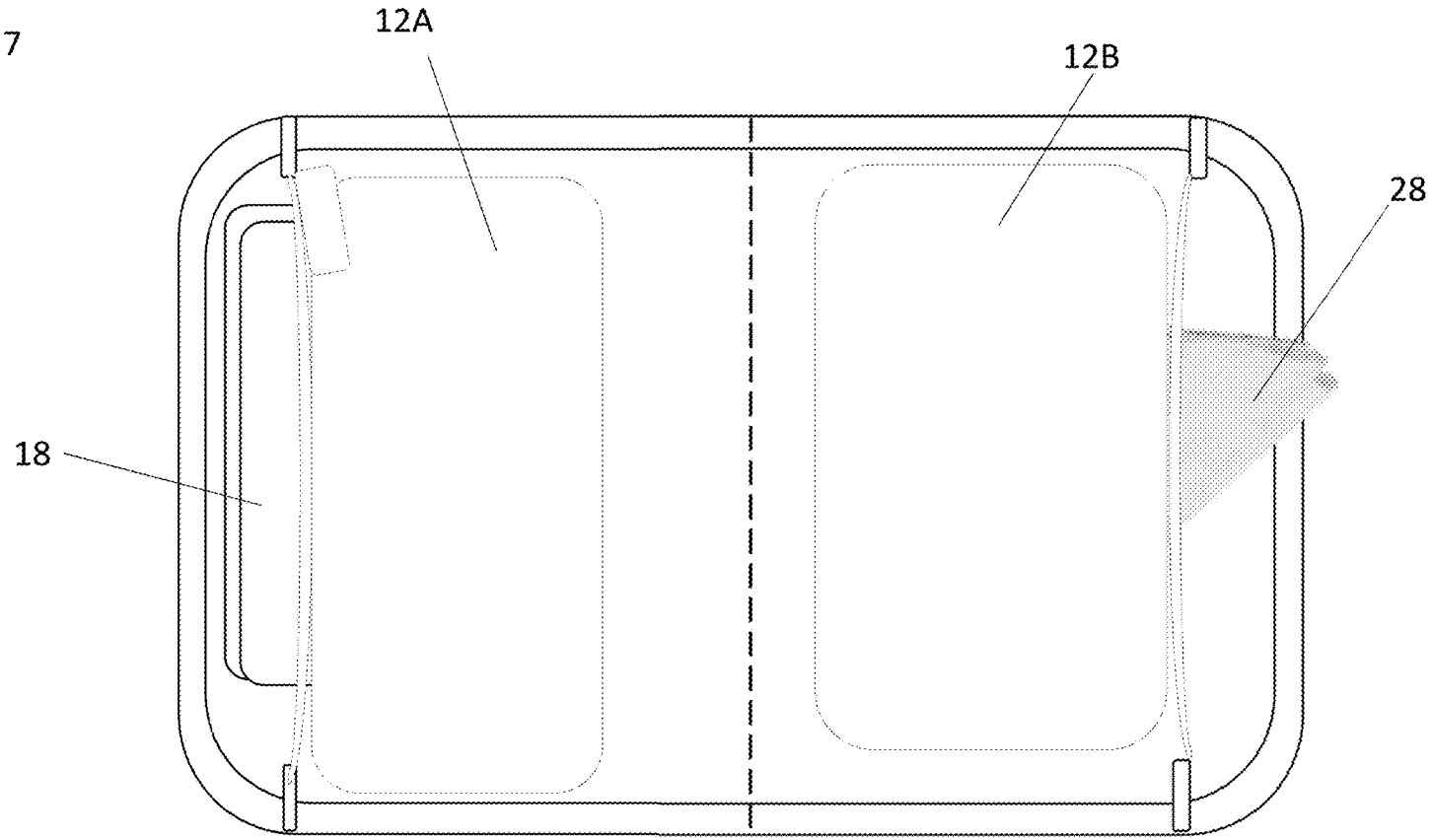
FIG. 7 illustrates a perspective view displaying the sanitary toilet kit's toilet seat cover and wipes in their respective pockets.

FIG. 7 illustrates a perspective view of one embodiment of the sanitary toilet kit's 10 toilet seat cover 18 and sanitary wipes 28 in their respective pockets 12A and 12B within the kit 10.

Figure 8:
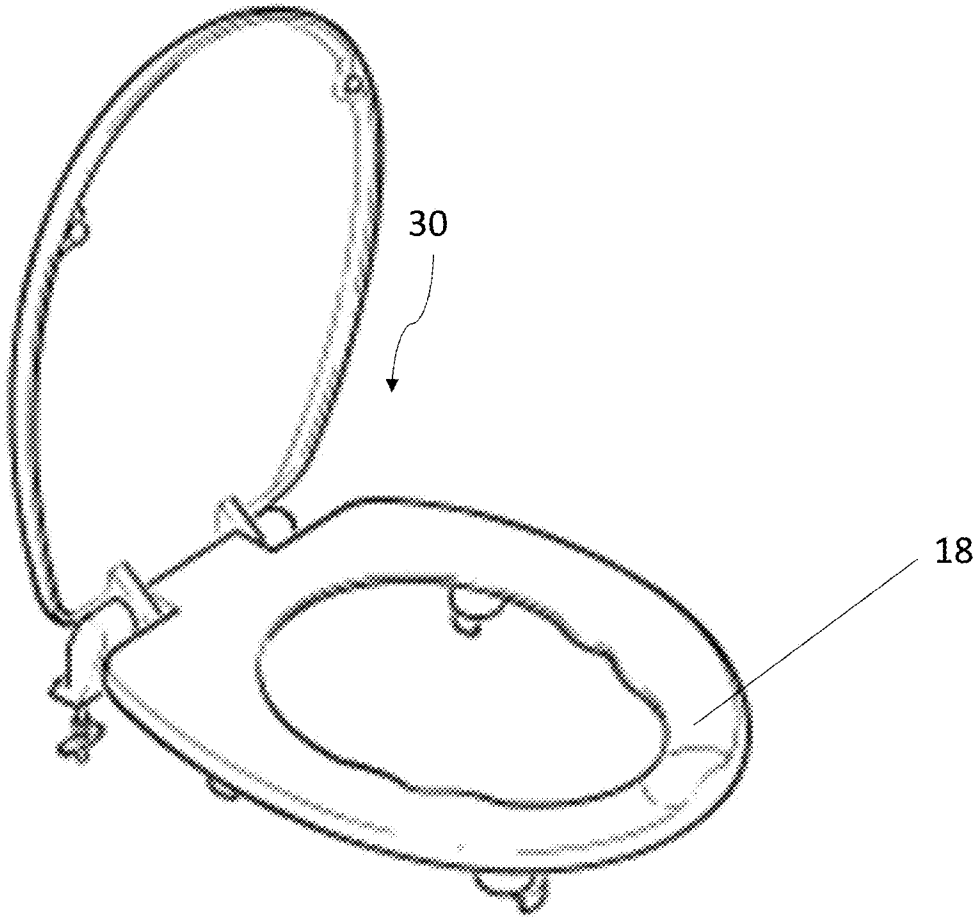
FIG. 8 illustrates one embodiment of the sanitary toilet kit's toilet seat cover utilized on a toilet seat.

FIG. 8 illustrates a perspective view of a toilet seat 30 wherein the toilet seat liner 18 is utilized on top of the toilet seat 30. As stated, the toilet seat liner 18 may be designed to fit a variety of toilet seats.

Thus has been outlined, rather broadly, preferred embodiments of the present invention and that numerous modifications or alterations may be made therein without departing from the spirit and the scope of the invention.

What is claimed is:

1. A sanitary toilet kit comprising:

a toilet seat cover, wherein the toilet seat cover is water soluble and further comprises:

a top side, wherein the top side possesses a smooth surface;

an opening, wherein the opening is placed over a toilet seat and aligned with a toilet bowl opening;

a toilet cut out flap that is placed within a toilet bowl;

a bottom side, wherein the bottom side comprises a series of perforations and an adhesive mechanism to prevent slippage when placed on the toilet seat;

a sanitary wipe, wherein the sanitary wipe is water soluble to allow the sanitary wipe to be flushed down a toilet;

a first sealed pocket; and a second sealed pocket;

wherein each sealed pocket is sealed around the sanitary toilet kit to prevent contamination.

2. The sanitary toilet kit of claim 1, wherein a user may break the seal of either sealed pocket to access the toilet seat cover and the sanitary wipe.

3. The sanitary toilet kit of claim 1, wherein a plurality of sanitary wipes is provided within the sanitary toilet kit.

4. The sanitary toilet kit of claim 1, wherein the toilet seat cover is sealed within the first sealable pocket and the sanitary wipe is sealed within the second sealed pocket.

* * * * *